US009812310B2

(12) United States Patent
Kovtoun et al.

(10) Patent No.: US 9,812,310 B2
(45) Date of Patent: Nov. 7, 2017

(54) ION SEPARATION AND STORAGE SYSTEM

(71) Applicant: Thermo Finnigan LLC, San Jose, CA (US)

(72) Inventors: Viatcheslav V. Kovtoun, Santa Clara, CA (US); Alexander A. Makarov, Bremen (DE)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/489,301

(22) Filed: Apr. 17, 2017

(65) Prior Publication Data

US 2017/0221689 A1 Aug. 3, 2017

Related U.S. Application Data

(63) Continuation of application No. 15/075,062, filed on Mar. 18, 2016, which is a continuation of application (Continued)

(51) Int. Cl.
*H01J 49/40* (2006.01)
*H01J 49/04* (2006.01)

(Continued)

(52) U.S. Cl.
CPC ..... *H01J 49/0422* (2013.01); *H01J 49/0027* (2013.01); *H01J 49/04* (2013.01); *H01J 49/062* (2013.01); *H01J 49/4295* (2013.01)

(58) Field of Classification Search
CPC ..... H01J 49/004; H01J 49/424; H01J 49/009; H01J 49/422; H01J 49/0031; H01J 49/4285; H01J 49/40; H01J 49/0081; H01J 49/04; H01J 49/062; H01J 49/063; H01J 49/406; H01J 49/421; H01J 49/4225;

(Continued)

(56) References Cited

U.S. PATENT DOCUMENTS 5,811,800 A 9/1998 Franzen et al.
5,905,258 A * 5/1999 Clemmer ..... G01N 27/622 250/282

(Continued)

FOREIGN PATENT DOCUMENTS

GB 2395063 10/2004
WO 2013/027055 A1 2/2013

*Primary Examiner* — David A Vanore
(74) *Attorney, Agent, or Firm* — Charles B. Katz

(57) ABSTRACT

Ions provided from an ion source are separated ions into a plurality of different ion groups according to at least one ion property. At least some of the different ion groups are stored in an ion storage array, which comprises a plurality of independently operable storage cells, each storage cell being arranged to receive and store a different ion group. A controller is programmed to cause selective switching of each of the storage cells between an ion receiving mode and an ion storage mode, and between the ion storage mode and an ion release mode. In particular, the switching of each storage cell is controllable independently of the switching of any of the other storage cells. Upon release from a respective storage cell of the array, ions are provided to one or more mass analyzers for subsequent analysis.

11 Claims, 4 Drawing Sheets

Related U.S. Application Data

No. 14/671,922, filed on Mar. 27, 2015, now Pat. No. 9,293,316.

(60) Provisional application No. 61/975,606, filed on Apr. 4, 2014.

(51) Int. Cl.
*H01J 49/06* (2006.01)
*H01J 49/42* (2006.01)
*H01J 49/00* (2006.01)

(58) Field of Classification Search
CPC ..... H01J 49/4295; H01J 49/0013; H01J 49/0027; H01J 49/0045; H01J 49/005; H01J 49/02; H01J 49/025; H01J 49/0422; H01J 49/06; H01J 49/061; H01J 49/10; H01J 49/165; H01J 49/401; H01J 49/403; H01J 49/408; H01J 49/42; H01J 49/44; G01N 27/622; G01N 30/72; G01N 30/6043; G01N 30/6095
USPC ..... 250/281, 282, 287, 288, 290, 292, 293, 250/294, 283, 286, 291, 489
See application file for complete search history.

(56) References Cited

U.S. PATENT DOCUMENTS 6,483,109 B1 * 11/2002 Reinhold ..... H01J 49/004 250/282
6,933,498 B1 * 8/2005 Whitten ..... H01J 49/009 250/282
6,987,263 B2 * 1/2006 Hobbs ..... G01N 30/6043 250/287
7,154,088 B1 12/2006 Blain et al.
7,178,124 B1 2/2007 Makarov et al.
7,381,947 B2 6/2008 Senko
7,560,688 B2 * 7/2009 Clowers ..... G01N 27/622 250/281
7,615,742 B2 * 11/2009 Brekenfeld ..... H01J 49/0081 250/281
7,718,403 B2 5/2010 Kamberov et al.
7,718,959 B2 * 5/2010 Franzen ..... H01J 49/4225 250/281
7,985,950 B2 7/2011 Makarov et al.
8,101,910 B2 * 1/2012 Loboda ..... H01J 49/004 250/281
8,206,913 B1 6/2012 Kamberov et al.
8,373,120 B2 2/2013 Verentchikov
8,513,595 B2 8/2013 Makarov et al.
8,581,177 B2 * 11/2013 Kovtoun ..... H01J 49/004 250/281
8,692,189 B2 4/2014 Makarov et al.
8,957,369 B2 2/2015 Makarov
8,975,581 B2 3/2015 Verdu Galiana
9,058,963 B2 6/2015 Makarov et al.
9,082,604 B2 7/2015 Verenchikov
9,099,289 B2 8/2015 Makarov
9,147,563 B2 9/2015 Makarov
9,293,316 B2 * 3/2016 Kovtoun ..... H01J 49/4295
2004/0026614 A1 2/2004 Bateman et al.
2004/0124354 A1 7/2004 Bateman et al.
2006/0289737 A1 12/2006 Bassmann et al.
2008/0067349 A1 * 3/2008 Moskovets ..... H01J 49/009 250/287
2008/0073497 A1 3/2008 Kovtoun
2008/0073498 A1 3/2008 Kovtoun
2009/0014647 A1 1/2009 Senko
2010/0078551 A1 4/2010 Loboda
2011/0024619 A1 2/2011 Makarov
2011/0284741 A1 11/2011 Stoermer et al.
2012/0104245 A1 * 5/2012 Makarov ..... H01J 49/004 250/287
2013/0068942 A1 3/2013 Verentchikov
2013/0228678 A1 9/2013 Savitski et al.
2014/0299761 A1 * 10/2014 Giles ..... H01J 49/421 250/283
2015/0021472 A1 * 1/2015 Makarov ..... H01J 49/0045 250/283
2015/0276676 A1 10/2015 Jiang et al.
2015/0287585 A1 10/2015 Kovtoun et al.
2015/0294850 A1 * 10/2015 Giles ..... H01J 49/422 250/282
2016/0071709 A1 * 3/2016 Hendricks ..... H01J 49/0013 250/282
2017/0032952 A1 * 2/2017 Verenchikov ..... H01J 49/403
2017/0140916 A1 * 5/2017 Giles ..... H01J 49/4285

* cited by examiner

ION SEPARATION AND STORAGE SYSTEM

CROSS-REFERENCE TO RELATED APPLICATIONS

The present application is a continuation under 35 U.S.C. §120 and claims the priority benefit of co-pending U.S. patent application Ser. No. 15/075,062, filed Mar. 18, 2016, which is a continuation of U.S. patent application Ser. No. 14/671,922, filed Mar. 27, 2015, which claims the priority benefit of U.S. Provisional Patent Application Ser. No. 61/975,606, filed Apr. 4, 2014. The disclosures of each of the foregoing applications are incorporated herein by reference.

FIELD OF THE INVENTION

The present invention relates generally to the field of mass spectrometry. More particularly, the present invention relates to systems and methods for separating ions into ion groups and accumulating the ion groups into cells of a storage array for subsequent mass analysis.

BACKGROUND OF THE INVENTION

"Ome" and "omics" are suffixes that are derived from genome (the whole collection of a person's DNA) and genomics (the study of the genome) and are applied nowadays to reflect different aspects of molecular biology: proteome, metabolome, glycome, etc. High-throughput mass analysis, which refers to a technology in which a large number of measurements can be taken in a fairly short time period, is essential for achieving even partial coverage during analysis of such collections of molecules. Without the ability to rapidly and accurately measure tens and hundreds of thousands of data points in a short period of time, there is no way to perform analyses at this level. In particular, high-throughput analysis in various "omics" studies requires a high duty cycle of operation, often by using a specially configured mass spectrometer. This requires that the mass analysis is not limited by low intensity of the incoming ion stream, or that the ions to be interrogated must be stored in a manner that enables high spectral quality of mass analysis. With ever increasing brightness of the ion source, the second approach turns out to be quite beneficial.

Proteomics and metabolomics studies often involve compounds that, despite their importance in the signaling/controlling pathways of complex biological networks, nevertheless occupy the very low end of the concentration range in a sample. Current data-dependent (DD) methods tend to miss a significant portion of these functionally important agents, due to the speed limitations of chromatographic separations as well as the use of abundance-driven algorithms for choosing precursor ions. In practice the number of compounds studied is relatively small, typically hundreds to thousands of compounds, limited by the number of spectra the mass spectrometer is capable of acquiring over the duration of an experiment. A more attractive approach is to subject all or almost all precursor ions to structural analysis, rather than only those meeting predefined abundance criteria. Unfortunately, such untargeted analysis deals with possible numbers of compounds in the tens of thousands to millions; given these numbers, it is not possible to allocate even a single scan of the mass analyzer to each compound in a complex biological sample.

Stand-alone Orbitrap-based as well as time-of-flight (TOF) mass spectrometers have been used for the simultaneous acquisition of all fragments from all precursors, to obtain one high-resolution, high mass-accuracy spectrum with subsequent targeted analysis of a compound of interest. However, the linearity, dynamic range and detection limits for a specific compound of interest, in a typical sample having an extremely large range of concentrations, are adversely affected by low ion transmission and limitations of the detection electronics in the TOF analyzer, and by the limited capacity of external trapping devices in the Orbitrap-based instruments.

Various solutions have been proposed based on tandem mass spectrometer arrangements, in which precursor ions formed from a particular compound are selected by a quadrupole analyzer and the fragments produced by dissociation of the precursor are analyzed using Orbitrap-based or TOF analyzers. Such hybrid instruments yield high-resolution, high mass-accuracy fragment spectra and have been used in accordance with various methods of targeted and untargeted analysis. Of course, while all fragments are analyzed in parallel the different precursor compounds are selected one at a time, and accordingly relatively more time is needed to obtain high-quality spectra of low-intensity precursors. As a result, the practical throughput of such systems is low.

Other solutions based on multi-channel MS/MS have also been proposed, in which each of a plurality of parallel mass analyzers is used to select one precursor compound and scan out its fragments to an individual detector. Examples of such systems include: the ion trap arrays disclosed in U.S. Pat. No. 5,206,506 or U.S. Pat. No. 7,718,959; the multiple traps disclosed in U.S. Pat. No. 6,762,406; and the multiple TOFs disclosed in US PG-PUB No. 2008067349. Such arrays speed up the analysis but typically this is achieved at the cost of poor utilization of the sample stream for each particular element of the array, since each element of the array is filled either sequentially or from its own source.

In a different approach, improved throughput is achieved by separating the ion beam into packets or groups of multiple precursor ion species, each group containing ions having an m/z value or another physico-chemical property (e.g. cross-section) that lies within a window of values, and each group is fragmented without the loss of the other groups, or multiple groups are concurrently and separately fragmented. Such parallel selection potentially supports utilization of the analyte to its full extent. Several configurations have been suggested, including: a scanning device that stores ions of a broad mass range (e.g. a 3D ion trap as disclosed in PCT Publication No. WO03103010, or a linear trap with radial ejection as disclosed in U.S. Pat. No. 7,157,698); pulsed ion mobility spectrometer (as disclosed in PCT Publication No. WO0070335, UA20030213900, U.S. Pat. No. 6,960,761, e.g. so-called time-aligned parallel fragmentation, TAPF); slowed-down linear (WO2004085992) or multi-reflecting TOF mass spectrometer (WO2004008481); or even magnetic sector instruments.

In all cases, the first stage of ion separation into distinct ion groups based on m/z or cross-sections is followed by fast fragmentation, e.g. in a collision cell (preferably with an axial gradient) or by a pulsed laser. Then fragments are analyzed (preferably by a TOF analyzer) on a much faster time scale than the scanning duration, although performance is constrained by the very limited time that is allocated for each scan (typically, 50-200 μs).

Unfortunately, the above-noted methods are based on using trapping devices to provide high duty cycle of the separator, and the cycle time is defined by the cycle time of the slowest analyzer, i.e., the separator. Modern ion sources produce ion currents in the range of hundreds to thousands of pA, i.e. $>10^9$ to $10^{10}$ elementary charges/second. Assuming a full cycle of scanning through the entire mass range of interest is 5 ms, then such trapping devices should be able to accumulate at least 5 million elementary charges and still allow efficient precursor selection. In practice, all parallel selection methods suffer from one or more of the following drawbacks: relatively low resolution of precursor selection (in practice not better than 10-50 Thomson (Th); insufficient space charge capacity of the trapping device (which frequently negates all advantages of parallel separation, cumbersome control of ion populations; relatively low resolving power (in some cases not more than several hundred) of fragment analysis; and low (e.g. 0.5-2 amu) mass accuracy of fragment analysis.

U.S. Pat. No. 8,581,177 addresses the problems that are associated with ion storage limitations of the trapping devices in parallel selection methods. In particular, a high ion storage/ion mobility instrument is disposed as an interface between an ion source inlet and a mass spectrometer. The high ion storage instrument is configured as a two-dimensional (2D) array of a plurality of sequentially arranged ion confinement regions, which enables ions within the device to be spread over the array, each confinement region holding ions for mass analysis being only a fraction of the whole mass range of interest. Ions can then be scanned out of each confinement region and into a respective confinement cell (channel) of a second ion interface instrument. Predetermined voltages are adjusted or removed in order to eliminate potential barriers between adjacent confinement cells so as to urge the ions to the next (adjacent) confinement cell, and this is repeated until the ions are eventually received at an analyzer. The ions are therefore transported in a sequential fashion from one confinement cell to the next, and as such it is possible only to analyze each group of ions in a predetermined order that is based on the original ion mobility separation. In particular, the approach that is proposed in U.S. Pat. No. 8,581,177 does not support a method of analyzing the confined groups of ions in an on-demand fashion.

It would therefore be beneficial to provide a system and method that overcomes at least some of the above-mentioned drawbacks of the prior art.

SUMMARY OF EMBODIMENTS OF THE INVENTION

In accordance with an aspect of at least one embodiment of the invention, there is provided an ion storage mass spectrometer, comprising: an ion source for providing ions; at least one ion separator positioned to receive ions that are produced in the ion source and being configured to separate said ions into a plurality of different ion groups according to at least one ion property; an ion storage array comprising a plurality of independently operable storage cells, each storage cell being arranged to receive a different ion group of the plurality of different ion groups from the at least one ion separator; a voltage source coupled to the ion storage array for establishing different electric field conditions within each different storage cell of the ion storage array, each of the different electric field conditions supporting the storage of only one ion group of the plurality of different ion groups; a controller programmed to cause the voltage source to selectably switch each of the storage cells between an ion receiving mode and an ion storage mode, and between the ion storage mode and an ion release mode, the switching of each storage cell being controllable independently of the switching of any of the other storage cells; and one or more mass analyzers for receiving ion groups that are released from the ion storage array when one or more the storage cells are switched from the ion storage mode to the ion release mode.

In accordance with an aspect of at least one embodiment of the invention, there is provided a method of mass spectrometric analysis, comprising: providing a first population of ions produced from a sample in an ion source; performing at least one of a mobility-based separation of the ions and a mass-to-charge (m/z) based separation of the ions, to form at least a first ion group comprising ions within a first known window of m/z or mobility values and a second ion group comprising ions within a second known window of m/z or mobility values, the first known window other than overlapping with the second known window; selectively directing the first ion group into a first storage cell of an ion storage array and selectively directing the second ion group into a second storage cell of the ion storage array; temporarily storing the first ion group within the first storage cell and temporarily storing the second ion group within the second storage cell; providing a second population of ions produced from the sample in the ion source; performing the at least one of the mobility-based separation of the ions and the m/z-based separation of the ions, to form at least a third ion group comprising ions within the first known window of m/z or mobility values and a fourth ion group comprising ions within the second known window of m/z or mobility values; selectively directing the third ion group into the first storage cell of the ion storage array prior to releasing the first group of ions from the first storage cell; and directing the fourth group of ions to a location other than the second storage cell of the ion storage array.

In accordance with an aspect of at least one embodiment of the invention, there is provided a method of mass spectrometric analysis, comprising: producing a plurality of ion populations from a sample, the ion populations being produced according to a time sequence such that a time interval elapses between the producing of successive ion populations; separating each one of the plurality of ion populations into a plurality of different ion groups based on at least an ion property, each different ion group comprising ions within a different known window of ion property values, and each ion population of the plurality of ion populations being separated during the time interval that occurs immediately after it is produced; after each separation, storing at least some ion groups of the plurality of different ion groups within different predetermined storage cells of an ion storage array, each different predetermined storage cell supporting the storage of only one ion group of the plurality of different ion groups; after each separation, determining a current ion population stored within each predetermined storage cell of the ion storage array based on a previously measured abundance of the ions that are produced from the sample, and based on a number of separating and storing cycles that each predetermined storage cell has undergone since releasing a previous ion population therefrom; and in dependence upon determining that a first storage cell of the ion storage array contains a current ion population that exceeds a target ion population of the first storage cell, releasing the ions from the first storage cell for subsequent processing, independent of releasing the ions from any of the other storage cells; and in dependence upon determining that a second storage cell of the ion storage array contains a current ion population that other than exceeds a target ion population of the second storage cell, other than releasing the ions from the second storage cell.

In accordance with an aspect of at least one embodiment of the invention, there is provided a method of mass spectrometric analysis, comprising: providing an ion population produced from a sample in an ion source; performing a separation of the ion population based on an ion property, comprising separating the ion population into a plurality of different ion groups, each different ion group comprising ions within a different window of ion property values; providing an ion storage array comprising a plurality of independently operable storage cells; establishing different electric field conditions within each different storage cell of the ion storage array, each of the different electric field conditions supporting the storage of ions within the window of ion property values of only one ion group of the plurality of different ion groups; storing each ion group of the plurality of different ion groups within a different predetermined storage cell, such that the ions of each different ion group are stored within a storage cell having electric field conditions that supports the storage of said ions; and selectively switching a first storage cell from an ion storage mode to an ion release mode, independently of switching any of the other storage cells from the ion storage mode to the ion release mode, for releasing the ions that are stored within the first storage cell and for retaining the ions that are stored in the other storage cells in a stored condition within said other storage cells.

In accordance with an aspect of at least one embodiment of the invention, there is provided an ion storage mass spectrometer, comprising: an ion source for providing ions; a first ion separator for separating the ions into a plurality of ion groups based on a first ion property, each different ion group comprising ions within a different window of ion property values; a second ion separator for further separating each of said plurality of ion groups to provide at least one ion sub-group based on mass-to-charge ratio (m/z), the at least one ion sub-group of each ion group comprising ions within a known m/z sub-window; one or more mass analyzers for analyzing the ions of each ion sub-group; and an ion storage array comprising a plurality of independently operable ion storage cells, the ion storage array being one of: disposed between the first ion separator and the second ion separator for receiving the plurality of ion groups from the first ion separator, for storing each received ion group within a different predetermined ion storage cell, and for selectively releasing said ion groups for introduction into the second ion separator; or disposed between the second ion separator and the one or more mass analyzers for receiving the plurality of ion sub-groups from the second ion separator, for storing each received ion sub-group within a different predetermined ion storage cell, and for selectively releasing each of said ion sub-groups for introduction into the one or more mass analyzers.

In accordance with an aspect of at least one embodiment of the invention, there is provided a method of mass spectrometric analysis, comprising: providing a population of ions; performing a first separation of the population of ions based on an ion property, thereby forming a plurality of different ion groups, each different ion group comprising ions within a different known window of ion property values; performing a second separation of the population of ions to form a plurality of ion sub-groups, comprising separating each different ion group based on mass-to-charge (m/z) ratio to form at least one ion sub-group, wherein each different ion sub-group of the plurality of ion sub-groups comprises ions within a different known m/z window; providing an ion storage array comprising a plurality of independently operable ion storage cells, each ion storage cell supporting the trapping of only one ion group or of only one ion sub-group; and one of: trapping within each storage cell only one ion group of the plurality of different ion groups, subsequently releasing the ions that are stored within at least one storage cell of the plurality of storage cells, and subjecting the released ions to the second separation; and trapping within each storage cell only one ion sub-group of the plurality of different ion sub-groups, subsequently releasing the ions that are stored within at least one storage cell of the plurality of storage cells, and subjecting the released ions to mass analysis using a mass analyzer.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

Figure 1:
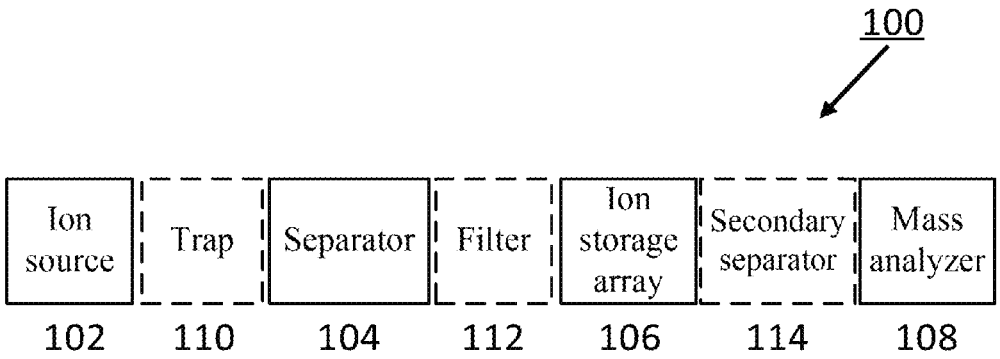
FIG. 1 is a functional block diagram of a system according to an embodiment of the present invention.

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, and is not intended to be limiting, unless implicitly or explicitly understood or stated otherwise. In addition, unless otherwise indicated, numbers expressing quantity of ingredients, constituents, reaction conditions and so forth used in the specifications and claims are to be understood as being modified by the term "about."

FIG. 1 is a functional block diagram of a system 100 in accordance with an embodiment of the present invention. Ions are generated in an ion source 102, and are subsequently introduced into a separator 104 to be separated into a plurality of different ion groups based on an ion property, such as for instance mass-to-charge (m/z) ratio, mobility, or another physico-chemical property of the ions. By way of a specific and non-limiting example, the separator 104 is an ion mobility (IM) separator, such as for instance a drift-tube IM separator. In this specific example the ions are separated into smaller ion groups on the basis of ion mobility values, which are influenced by the m/z values of the ions but do not correspond directly to the m/z values. In fact, mobility values depend on the ion charge, drift gas number density, reduced mass of the ion and drift gas, drift gas temperature and the ion collision cross section with the drift gas. Nevertheless, for the purpose of the following discussion the separator 104 is assumed to separate the ions into smaller groups of ions, each smaller group of ions comprising ions within a different approximate m/z window. For instance, the separator 104 is assumed to separate the ions into a plurality of different ion groups each having an approximate m/z window of about 40 Thomson (Th). Prediction of m/z window for each precursor could be done using calibration curves acquired for each charge state, while current charge state of the precursor could be determined in a panoramic high-resolution precursor scan.

Referring still to FIG. 1, the ion source 102 is optionally a continuous ion source such as an electrospray ionization (ESI) source, or a pulsed ion source that is capable of producing ion packets with durations significantly shorter than the time that is required to separate the ions in the separator 104. When a continuous ion source is used the ions are gated into the separator 104, either with or without first being trapped and/or accumulated using an optional trap 110.

The ion groups are passed from the separator 104 to an ion storage array 106, and each different ion group is stored in a different storage cell of the ion storage array 106. As is discussed in greater detail in the following sections, some of the storage cells will require only one separation/filling cycle to accumulate a desired number of ions while other storage cells will require plural separation/filling cycles. The number of separation/filling cycles that a particular storage cell undergoes may be determined, at least in part, by the aggregate ion abundance of the ion group that is being stored therein. More particularly, each storage cell is controlled to accumulate and store ions until a target ion population size is achieved, after which the ions may be released and transported to a mass analyzer 108, which may be any type of mass analyzer. Optionally, release of the ions from a particular storage cell occurs immediately after that storage cell has accumulated its target ion population, or alternatively ion release is delayed until the end of an additional ion storage period. Ion release may be delayed, for instance, in order to avoid releasing ions from more than one storage cell at a time or to allow the mass analyzer to complete its previous scans.

Optionally, the ions are subjected to an additional separation prior to being mass analyzed using mass analyzer 108, either based on the same ion property or based on a different ion property. For instance, an optional mass filter 112 disposed between the separator 104 and the ion storage array 106 can be used to mass-selectively transmit ions of interest for storage in the storage array. Alternatively, an optional secondary ion separator 114 disposed between the storage array 106 and the mass analyzer 108 can be used to further separate a group of ions after it is released from the storage array, either based on the same ion property or based on a different ion property. Optionally, a secondary ion storage array (not illustrated in FIG. 1) may be provided between the secondary ion separator 114 and the mass analyzer 108, for storing the further separated ion groups that are received from the secondary separator 114 prior to mass analysis. By way of a specific and non-limiting example, the separator 104 separates the ions into a plurality of ion groups each having an approximate m/z window of 40 Th, and the filter 112 or the secondary ion separator 114 further separates each ion group into a plurality of smaller ion groups each having an approximate mass window of 4 Th.

Figure 2:
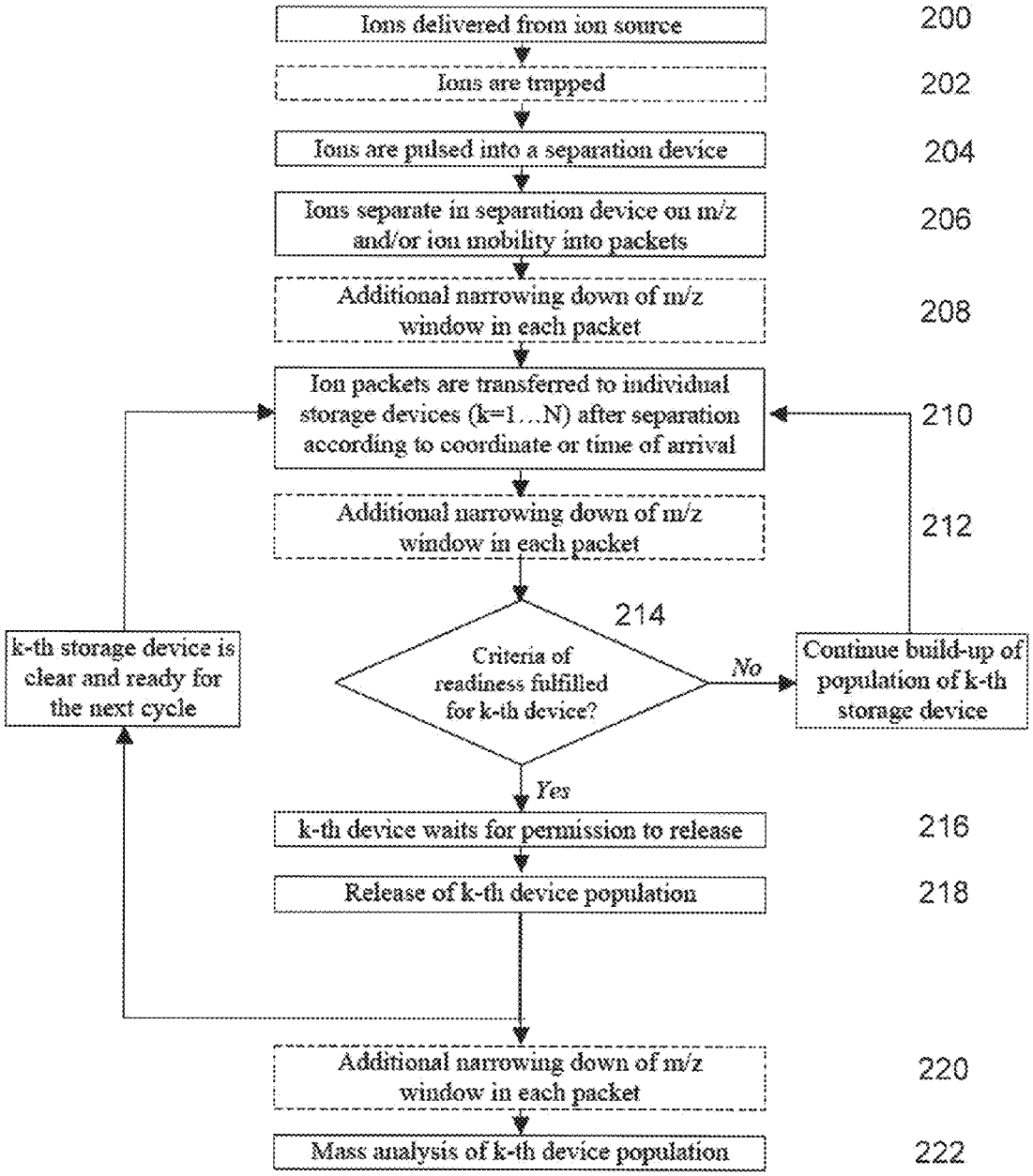
FIG. 2 is a simplified diagram depicting the various operations that are performed during the analysis of ion populations using the system of FIG. 1.

Referring now to FIG. 2, shown is a simplified diagram depicting the various operations that are performed during the analysis of an ion population using the system of FIG. 1. Depending on the nature of the analysis that is being performed, and depending on the specific physical and electronic configurations of the system of FIG. 1, some of the operations that are shown in FIG. 2 may be omitted and/or optional (dashed-line boxes), or may be performed in a sequence that is different than the one that is depicted in FIG. 2. At operation block 200 a population of ions is delivered from the ion source 102. The ions are pulsed into the separator 104 at operation block 204, with optional trapping of the ions at operation block 202. For instance, the optional trapping is performed to accumulate a sufficiently large ion population within the trap 110 prior to releasing the ions into the separator 104. At operation block 206 the ion population is separated into a plurality of different ion groups based on an ion property, such as for instance m/z, mobility (cross-section) or another physico-chemical property of the ions. In one specific implementation, operation block 206 comprises a distance-of-flight ion mobility separation using the separator 104.

At operation block 210, at least some ion groups of the plurality of different ion groups are transferred to individual storage cells of the ion storage array 106. As few as two different ion groups and as many as all of the different ion groups may be transferred to the individual cells. Each different ion group, which comprises ions within a different window of the ion property values (which will typically correspond, at least roughly, to a range of m/z values), is transferred to a predetermined one of the storage cells that supports storage of the ions within that window of values. In the specific implementation that employs a distance-of-flight ion mobility separation, the ion groups become spatially resolved within the separator 104 and may be transferred simultaneously to respective individual storage cells, such as for instance by the application of an electrical field that is transverse to a direction of ion mobility separation. In the specific implementation that employs a time-of-travel ion mobility separation, the different ion groups are transferred to respective individual storage cells one at a time as they emerge from the separator 104 in order of decreasing ion mobility. This latter implementation optionally includes the mass filter 110 that is shown in FIG. 1, which is disposed between the separator 104 and the storage array 106. During use, the RF and DC voltages that are applied to the parallel rods of the mass filter 110 are varied in order to scan RF/DC, and thereby narrow down the m/z range within each ion group after it emerges from the separator 104. The groups of filtered ions are then directed to separate storage cells in the storage array 106 at operation block 210. In this way, the approximate m/z window of each ion group that emerges from the separator 104 can be narrowed from approximately 40 Th to between about 4 Th and about 10 Th, prior to being stored in the storage array 106. Optionally, in either one of the implementations described above, some of the ions within at least some of the individual storage cells are selectively released at operation block 212, so as to adjust the size of the stored ion group and/or to further narrow the m/z window of the stored ion group.

It is then determined, at decision block 214, whether or not the $k^{th}$ storage cell (where k=1 . . . N) satisfies a criterion of readiness. As discussed previously, the abundance of some of the ions in an ion population is significantly lower than the abundance of other ions in the ion population. For this reason, each of the individual storage cells is expected to contain a different number of ions after operation block 210 is completed. By way of a specific and non-limiting example, the criterion of readiness is a predetermined target ion population size. In this example, the $k^{th}$ storage cell is considered to fulfill the criterion of readiness if the number of ions stored therein meets or exceeds the predetermined target ion population size. When it is determined that the $k^{th}$ storage cell does not fulfill the criterion of readiness, then the $k^{th}$ storage cell is subjected to at least one more separation/filling cycle. For instance, the $k^{th}$ storage cell returns to operation block 210, another ion group is transferred into the $k^{th}$ storage cell, and a fresh determination is made at decision block 214. In this way, the ion population in the $k^{th}$ storage cell continues to build up until it is determined, at decision block 214, that the $k^{th}$ cell does satisfy the criterion of readiness.

When it is determined at decision block 214 that the $k^{th}$ cell does satisfy the criterion of readiness, after either one separation/filling cycle or after plural separation/filling cycles, then the $k^{th}$ storage cell progresses to operation block 216 and waits for a control signal to release the stored ions. At operation block 218 the $k^{th}$ storage cell receives the control signal, releases the ions that are stored therein, and returns to operation block 210. Optionally, the released ions are subjected to a further separation at operation block 220 prior to being mass analyzed at operation block 222. For instance, in a specific implementation the secondary separator 114, which may be provided in the form of an array of linear ion traps, is used to narrow the m/z windows of the ions that are ultimately transported to the mass analyzer 108 at operation block 222. Optionally, a secondary storage array is disposed between each linear ion trap and the mass analyzer 108.

Of course, each of the N storage cells operates in the same manner that is described above with reference to the $k^{th}$ storage cell. In particular, each ion group of the plurality of different ion groups is transferred to a predetermined one of the N storage cells at operation block 210. At decision block 214 a determination is made whether or not each of the N storage cells satisfies a criterion of readiness, where different readiness criteria may be associated with different ones of the N storage cells. Storage cells that satisfy the readiness criterion wait, at operation block 216, for a control signal to release the stored ions. On the other hand, storage cells that do not satisfy the readiness criterion are subjected to at least one additional separation/filling cycle. At operation block 218 a process in execution on a controller causes the ions to be released from those storage cells that satisfy the readiness criterion. In particular, the process triggers the release of ions from different storage cells at different times, in dependence upon the different storage cells becoming ready to release the ions. As a result, the control process triggers the release of ions from the individual storage cells in other than a fixed predetermined order. Decision block 214 does not necessarily involve measuring the ion population sizes in the storage cells. For instance, wide- or narrow-mass range scans may be performed using the downstream mass analyzer 108, to obtain a "snapshot" of the different ions that are present in an ion population, and to determine the relative abundances thereof. Based on these mass scans the number of ions in each storage cell can be estimated or predicted during the course of analysis, for a given number of separation/filling cycles.

Figure 3:
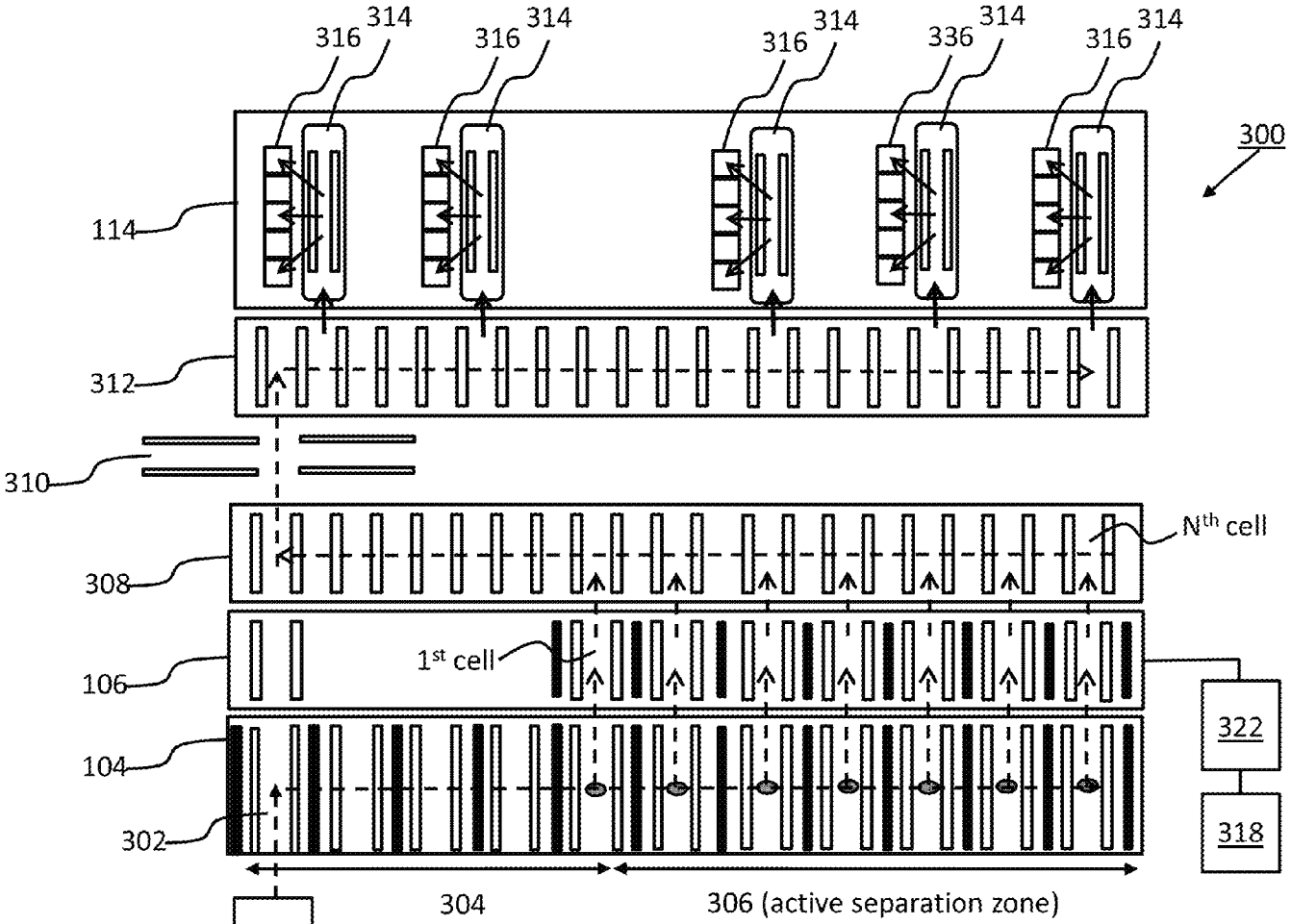
FIG. 3 is a simplified diagram showing a system according to an embodiment of the present invention.

FIG. 3 shows an exemplary mass spectrometer, designated generally by the reference numeral 300, in accordance with an embodiment of the invention. While the system 300 of FIG. 3 is beneficial for illustrative purposes, it is to be understood that other alternative configurations and having various other components, as known and understood by those in the field of mass spectroscopy, can also be incorporated when using the ion storage mass spectrometer disclosed herein.

During use, ions are produced in an ion source 102 for introduction into an ion separator 104. Dashed arrows are used in the drawing to depict the flow of ions throughout the system, and it is to be understood that different ion groups may flow along different paths, etc. In this specific and non-limiting configuration the separator 104 is a drift tube IM separator. Ions are accumulated in an ion introduction stage 302, for instance the trap 110 in FIG. 1, are injected into the drift tube, and subsequently traverse the drift tube in a direction of ion mobility separation. As is shown in FIG. 3, the separator 104 comprises a plurality of first electrodes (shown as open rectangles in the drawing) to which RF and DC potentials are applied, as well as a plurality of second electrodes (shown as solid rectangles in the drawing) to which only a DC potential is applied. The first electrodes are elongated electrodes oriented transverse to the direction of ion mobility separation, and are arranged in pairs so as to define a series of adjacent confinement cells. Optionally, the elongated first electrodes are segmented along their respective lengths. The second electrodes are auxiliary electrodes that are used to confine ions within the confinement cells and assist with the transfer of ions out of the ion separator 104 and into the adjacent storage array 106. Thus, after passing through a zone 304 of initial mobility-based separation, the ions become further separated into a plurality of different ion groups within an active separation zone 306, by which time the ion introduction stage 302 is already storing ions for a next injection. In the configuration that is shown in FIG. 3 the separation is a distance-of-flight IM separation, such that the different ion groups become separated spatially along the length of the active separation zone 306, within respective confinement cells between the pairs of first electrodes. A drift tube having a length of 0.5 meters and operating at a pressure of 3-6 mbar with a typical field strength of 5-20 V/cm, with a trap 110 of 20-40 $cm^3$ and supporting storage of up to $2*10^7$ charges, achieves an ion mobility resolving power of 40-60, requires a typical separation time of 10 ms, and thus matches well with the incoming ion flow rate.

The system 300 is depicted in FIG. 3 at a time when the separation of the initial ion population into a plurality of different ion groups is substantially complete, and the process of ion storage in the ion introduction stage 302 for the next injection is close to an end. More particularly, the initial ion population has been separated into a plurality of different ion groups (shown in FIG. 3 as spaced-apart ovals), which are distributed along the length of the separator 104. Each different ion group, which occupies a 20-40 Th wide approximate m/z window, is depicted at a location within the ion separator 104 that is adjacent to one of the N storage cells of ion storage array 106. The electric field in the separator 104 is switched off at this point, and an orthogonal electric field is established to drive the different ion groups out of the separator 104 and into a respective one of the N storage cells of the ion storage array 106. For instance, suitable DC potentials are applied to segmented first electrodes of the separator 104, and/or suitable DC potentials are applied to the second electrodes of the separator 104.

The storage cells of the ion storage array 106 are independently controllable. To this end, a controller 318 is provided for controlling a voltage source 322 to apply selected potentials to the storage cells of the ion storage array 106, for selectively switching each storage cell between an ion receiving mode and an ion storage mode, and for selectively switching each storage cell between the ion storage mode and an ion release mode. More particularly, each storage cell is switched between the different operating modes independently of the switching of any of the other storage cells in the array 106.

Under the control of a controller, the storage cells are used to temporarily store the different ion groups and then release the different ion groups for further processing and detection. A first plurality of electrodes, which is collectively shown as a first ion transport device 308, is provided for receiving the ions that are released from the storage cells and for transporting the ions onward. In particular, the first ion transport device 308 transports the released ions away from the ion storage array 106 while at the same time a subsequent ion mobility separation is occurring within the ion separator 104. For instance, after separating a first ion population in the separator 104, each storage cell receives ions comprising one ion group of the plurality of different ion groups. A second ion population is introduced into the separator 104 and a next plurality of different ion groups begins to separate within the active separation zone 306. Prior to completing the separation of the second ion population, the ions that are stored in some of the storage cells may be released while the ions that are stored in other storage cells may be retained. The decision to release or retain the ions in a particular storage cell depends upon whether or not a predetermined criterion has been satisfied. For instance, ions are retained within a particular storage cell unless it is determined that the number of ions meets or exceeds a target ion population size. In this way, some storage cells will undergo only one separation/filling cycle prior to releasing ions for further processing, while other storage cells will undergo plural separation/filling cycles prior to releasing ions for further processing. Stated in a different way, ion groups that comprise high abundance ions will "fill" the respective storage cells after as few as one separation/filling cycle, but ion groups that comprise low abundance ions will "fill" the respective storage cells after two or more separation/filling cycles. For high abundance ion groups, there might in fact be no need to store the ions, as they could be directly transported to the mass analyzer without "stopping" in the array 106. Of course, if it is determined that more than one of the storage cells is "full" at a particular time, then the ions may be released from these cells sequentially in time or in some sequence based on the location of the cell in the array. Further, if a storage cell is already full and additional ions are directed into it from the separator 104, then an additional gate at the entrance to the cell could be used to discard excess ions.

Subsequent to releasing the ions out of a storage cell, that storage cell becomes available to receive a next ion group during a next separation/filling cycle. Another storage cell that does not release its ion group may instead continue to store the ion group that it received during the first separation/filling cycle, and also receive a next ion group during the next separation/filling cycle. In this way, low abundance ions are accumulated during the course of plural separation/filling cycles, until a target ion population size is achieved, and the aggregated ions are released as a single group to receive further processing. In effect, the storage cells cooperate to form an asynchronously accessible storage array.

Referring still to FIG. 3, ions that are released from the $1^{st}$-$N^{th}$ storage cells of the ion storage array 106 are received by the first ion transport device 308. The first ion transport device 308 transports the ion groups along respective trajectories extending through a vacuum interface 310 into a vacuum chamber (not shown). Transporting the ion groups through the vacuum interface 310 takes only a few milliseconds, and therefore matches well with the ion mobility separation cycle. After passing through the vacuum interface 310, each different ion group is directed to predetermined ion trap 314 of the ion trap array 114. More particularly, a second plurality of electrodes collectively shown as a second ion transport device 312 is provided within the vacuum chamber. In this way, the ions of the initial ion population (produced in the ion source 102) become distributed between the individual ion traps 314 according to their primary ion mobility separation. Typically, the ion population in each ion trap 314 is approx. $1\text{-}5*10^5$ ions, which is acceptable for further separation into smaller groups extending over an approximately 4 Th range. A plurality of secondary storage cells 316 is associated with each ion trap 314, for temporarily storing the ions of each smaller ion group. Subsequently, the smaller ion groups are released from the secondary storage cells and are subjected to mass analysis.

By way of a specific and non-limiting example, high-resolution axial ion separation using linear ion traps can be performed at a speed exceeding $10^4$ Th/s. Thus, scanning out ions occupying 40 Th wide mass windows requires <4 ms combined scan/separation time. If lower than unit mass resolution is sufficient for a particular application, then the scan rate may be increased by a factor of at least two, thereby reducing the scan/separation time to only 2-3 ms. Additionally, the ion traps 314 of the ion trap array 114 operate in parallel, such that each ion group is separated into 4 Th wide mass windows simultaneously. Overall, the total time required to perform the ion mobility separation in the separator 104, transport the ions via the first and second ion transport devices 308 and 310, and perform the ion trap separation is approximately 10 ms. This value may be reduced if radial ejection is employed during the ion trap separation, but at the cost of increased complexity of the system 300. Since the total separation/transport time is equal to or less than the approximately 10 ms fill time for the ion storage array 106, it is possible to perform all-ions mass spectrometry without rejecting any of the ions that are produced in the ion source 102.

As discussed above, the ion trap array 114 of the system 300 comprises a plurality of individual ion traps 314. One beneficial characteristic of the system 300 is that each one of the individual ion traps is configured to interrogate ions within only a narrow mass range. Accordingly, the ion trap array 114 may be implemented by applying an identical radio frequency (RF) potential to every ion trap 314, wherein the $r_0$ value of the individual ion traps 314 gradually decreases across the ion trap array 314. Alternatively, the $r_0$ value all of the ion traps 314 is identical and stepped RF levels are applied to individual ion traps 314 of the ion trap array 114.

By way of an example, the ion storage array 106 in FIG. 3 comprises between 10 and 100 individual storage cells, preferably between 20 and 50 individual storage cells. The number of ion traps 314 in the ion trap array 114 is comparable with the number of storage cells in the ion storage array 106. For the purpose of facilitating an understanding of the present embodiment, only five ion traps 314 have been shown in FIG. 3. In practice, the ion trap array 114 typically comprises between 10 and 200 individual ion traps. Similarly, for the purpose of facilitating an understanding of the present embodiment, each plurality of secondary storage cells is depicted comprising only four secondary storage cells. In practice, each plurality of secondary storage cells typically comprises between 2 and 12 secondary storage cells, and preferably between 5 and 10 secondary storage cells. As such, the total number of secondary storage cells is between 20 and 1200, preferably between 100 and 500.

An optional modification of system 300 is the addition of a left hand branch of ion mobility separation, that is to say a mirror image of the separator 104 that is shown in FIG. 3. When ion separation takes place on the right side of the ion mobility device, ions from the previous fill may be moved/transported from the left side of the system.

Optionally, other types of separation as known in the art (e.g., TOF separator as shown e.g. in WO2012175517, scanning ion traps, etc.) is substituted for the ion mobility-based separation that occurs in separator 104, as soon as such other types of separation are capable of handling high ion flows as mentioned above.

Figure 4:
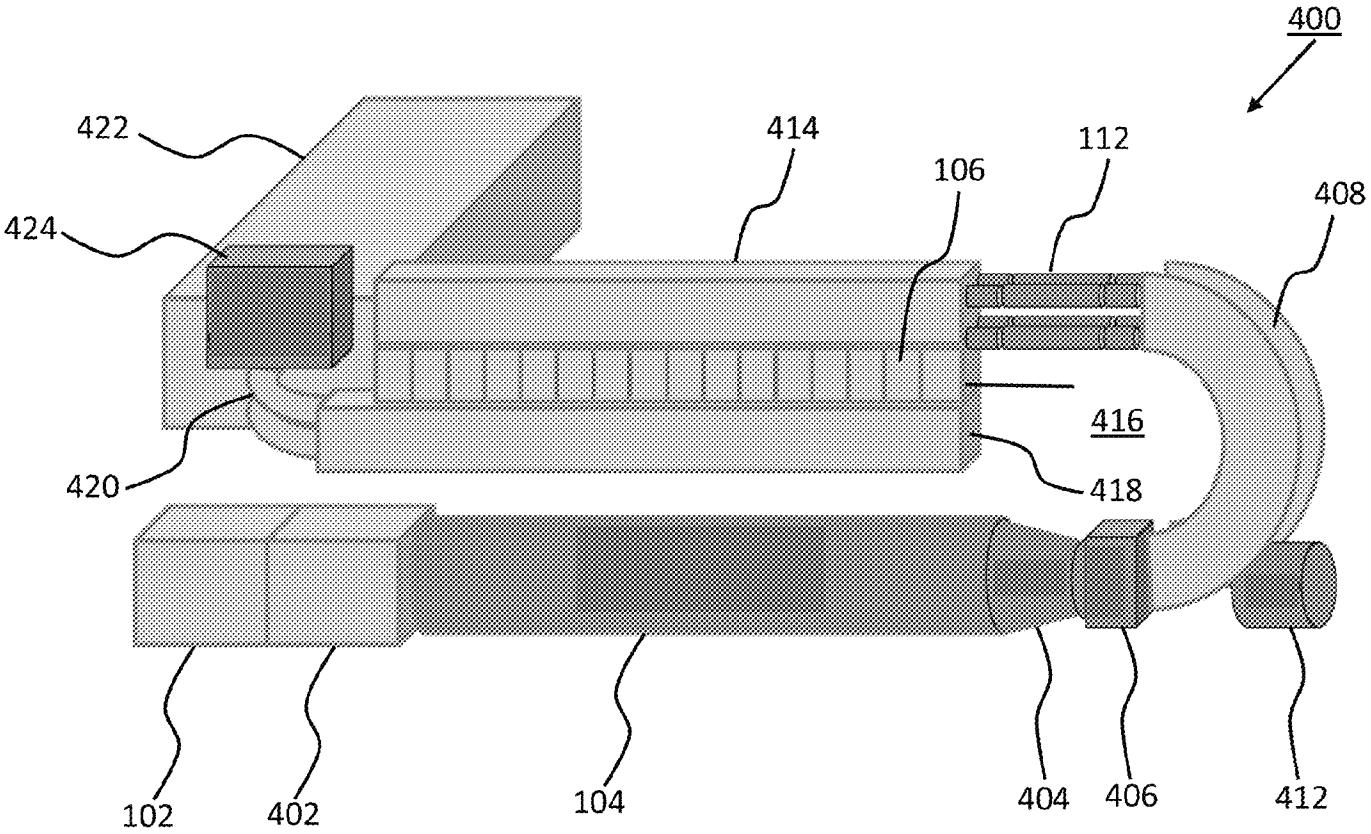
FIG. 4 is a simplified diagram showing another system according to an embodiment of the present invention.

FIG. 4 illustrates another example mass spectrometer, generally designated by the reference numeral 400, that is also in accordance with an embodiment of the invention. While the system 400 of FIG. 4 is beneficial for illustrative purposes, it is to be understood that other alternative configurations and having various other components, as known and understood by those in the field of mass spectrometry, can also be incorporated when using the ion storage mass spectrometer disclosed herein.

Unlike the system 300 that is shown in FIG. 3, which employs a distance-of-flight ion mobility separation in the separator 104, the system 400 initially separates ions based on time-of-travel through the ion mobility drift region of the separator 104.

During use, ions are produced in an ion source 102, accumulate in an ion introduction stage 402 such as for instance ion trap 110 in FIG. 1, and are subsequently injected into the separator 104. A continuous electric field is used to drive the ions in a direction of ion mobility separation, thereby separating the ions into a plurality of different ion groups each having mobility values roughly corresponding to a 20-40 Th wide m/z window. The ion groups emerge from the separator 104 in order of decreasing ion mobility, and are trapped and/or focused using funnel 404 as is known in the art. The different groups of ions are released through gate 406 and are transported via an ion guide 408 to a mass filter 112. The mass filter 112 is optional and may be omitted if additional filtering of the ion groups emerging from separator 104 is not desired. Optionally, in order to provide a compact design, the ion guide 408 is provided in the form of a curved ion guide. Further optionally, an ion dump 412 is provided to support the removal of unwanted ions from gate 406.

After traversing the ion guide 408, the ions pass through the optional mass filter 112 and into a branching RF guide 414. The optional mass filter 112 may be used to further narrow the approximate m/z window of the ion groups prior to storage in the storage array 106. A not illustrated voltage source applies either an RF-only potential or a combination of RF and direct current (DC) potentials to the electrodes of the mass filter 112. Application of an RF-only potential supports the transmission of ion groups through the mass filter 410 without further separation. In this case, the branching RF guide directs the ion groups that are formed in the separator 104 into the predetermined storage cells. In the filtering mode, application of a combined RF and DC potential results in the ion groups being further reduced into smaller packets based on m/z. By varying the combined RF and DC potentials applied to the mass filter 410, in either a discrete or continuous fashion, it is possible to selectively transmit different ion packets each occupying a narrow m/z range within the 20-40 m/z wide mass window of a respective one of the different ion groups. For instance, the mass filter 410 operates at a resolving power of 100-200 (4-10 amu windows) and a scan rate $>10^5$ amu/sec. The branching RF guide 414 then directs the filtered ions that have passed through the quadrupole mass filter 112 into separate, predetermined storage cells of the ion storage array 106.

The storage cells of the ion storage array 106 are independently controllable. To this end, a controller 416 is provided in communication with the ion storage array 106, for selectively switching each storage cell between an ion receiving mode and an ion storage mode, and between the ion storage mode and an ion release mode. More particularly, the controller 416 switches each storage cell between the different operating modes independently of the switching of any of the other storage cells in the array 106, and in other than a fixed predetermined order.

Under the control of the controller 416 the storage cells are used to temporarily store the different ion groups or ion packets, and then release the different ion groups or ion packets into a collecting RF guide 418, while at the same time a subsequent ion mobility separation is occurring in the separator 104. For instance, after separating a first ion population in the separator 104, each storage cell receives ions comprising one ion group of the plurality of different ion groups. A second ion population is introduced into the separator 104 and a next plurality of different ion groups begins to separate. Prior to completing the separation of the second ion population, the ions that are stored in some of the storage cells may be released while the ions that are stored in other storage cells may be retained. The decision to release or retain the ions in a particular storage cell depends upon whether or not a predetermined readiness criterion has been satisfied. For instance, ions are retained within a particular storage cell unless it is determined that the number of ions exceeds a target ion population size. In this way, some storage cells will undergo only one separation/filling cycle prior to releasing ions for further processing, while other storage cells will undergo plural separation/filling cycles prior to releasing ions for further processing. Stated in a different way, ion groups that comprise high abundance ions will "fill" the respective storage cells after as few as one separation/filling cycle, but ion groups that comprise low abundance ions will "fill" the respective storage cells after two or more separation/filling cycles. Of course, if it is determined that more than one of the storage cells is "full" at a particular time, then the ions may be released from these cells sequentially in time or in another sequence based on the location of the cell in the array. Optionally, one of the storage cells of the ion storage array 106 is operated in a permanently open mode, such that ions that are directed to this storage cell are received directly into the collecting RF guide 418 without first being stored in the array. For instance, the storage cell that is disposed closest to the filter 410 in the system shown in FIG. 4 could be operated in this fashion. The permanently open storage cell may be used to bypass the ion storage array 106 during acquisition of panoramic wide- or narrow-mass pre-scans, and/or for the analysis of very high abundance ions.

Subsequent to releasing the ions from a storage cell, that storage cell then becomes available to receive a next ion group during a next separation/filling cycle. Another storage cell may continue to store the ion group that it received during the first separation/filling cycle, but also receive a next ion group during the next separation/filling cycle. In this way, low abundance ions may be accumulated during the course of plural separation/filling cycles, until a target ion population size is achieved and the aggregated ions are released as a single group to receive further processing.

The ions that are released from the storage cells of the ion storage array 106 are received by the collecting RF guide 418, and are then transported along respective trajectories passing through a vacuum interface 420 and into mass spectrometer 422. Optionally a gate valve 424 is provided for controllably disengaging the entire separator and storage array from the mass spectrometer, for example for service operations.

By way of a specific and non-limiting example, the ion storage array 106 in FIG. 4 comprises between 10 and 100 individual storage cells, preferably between 50 and 100 individual storage cells, and separator 104 has length of 0.8 m and is formed by a set of 50 mm ID apertures with uniform DC distribution and alternating phases of RF applied to them. Collection of ions from the source 102 and from separator 104 could be done using ion funnel as known in the art.

Figure 5:
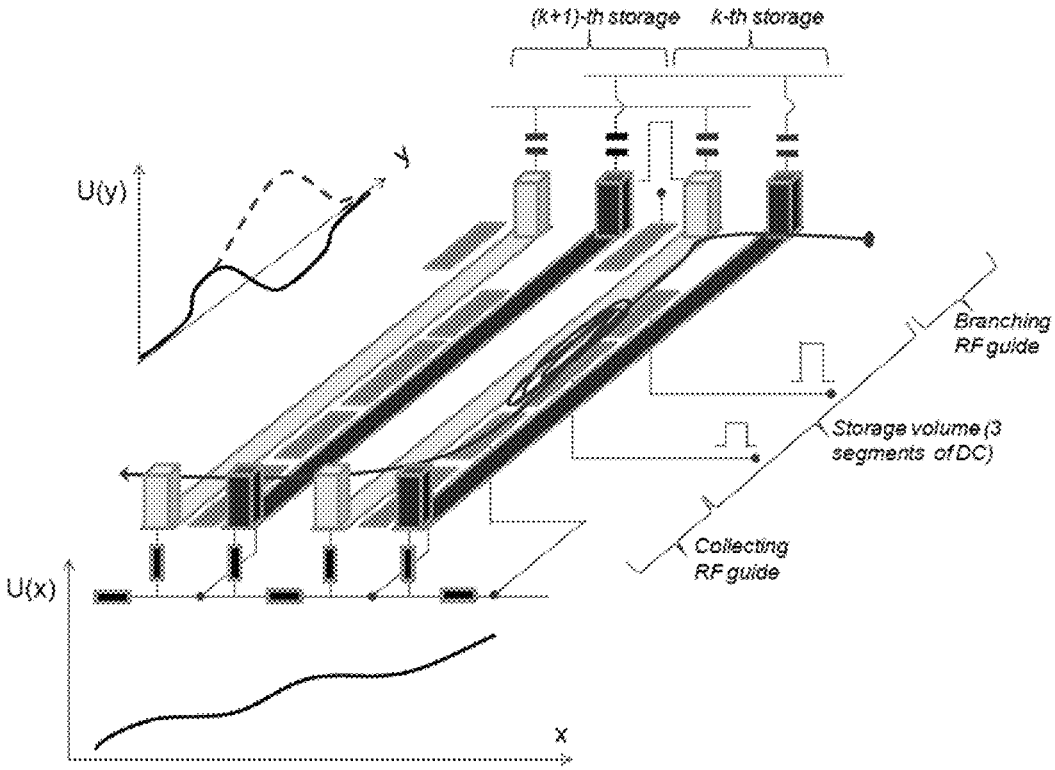
FIG. 5 is a simplified diagram of a preferred implementation of storage array using printed circuit boards, which integrate the branching RF guide, the storage array and the collecting RF guide of the system of FIG. 4.

Referring now to FIG. 5, shown is a simplified diagram of a printed circuit board (PCB) component defining the branching RF guide 414, the ion storage array 106 and the collecting RF guide 418 of the system 400 that is shown in FIG. 4. During operation, gas pressure is maintained in a typical range between 0.01 and 0.1 mbar. Each storage cell (the $k^{th}$ and $(k+1)^{th}$ storage cells are shown in FIG. 5) is floated at its own DC offset so that there is a DC gradient along the path of ions (x-direction in FIG. 5). A typical DC gradient is on the order of 5-20 V/cm. Additional voltages (up to 5-20 V) above the DC offsets are used to control and guide the ions. An ion group propagating along the x-direction through the branching RF guide 414 encounters a voltage barrier (created by a voltage pulse applied to control electrode 420 between the $k^{th}$ and $(k+1)^{th}$ storage cells) to further propagation when it reaches a predetermined storage cell, which in the example shown in FIG. 4 is the $k^{th}$ storage cell. At the same time the potential barrier along the y-direction of the $k^{th}$ storage cell is lowered, such that the ion group is directed into the gas-filled $k^{th}$ storage cell. Once the ion group enters the $k^{th}$ storage cell, the ions that comprise that group become trapped in the RF field and axial DC gradient along the y-direction (solid line in the U(y) graph). Nearest neighboring storage cells (i.e., $(k+1)^{th}$ storage cell in FIG. 5) are sufficiently remote from one another to remain fully independent. The stored ion group is released from the $k^{th}$ storage cell by the application of pulses to sections 414 and 106, creating an extraction field along the y-direction (dashed line in the U(y) graph), and enters the collecting RF guide 418. A permanent DC gradient exists within the RF collecting RF guide 418, which drives the released ions along the x-direction towards the vacuum interface 420 and then onward to the mass spectrometer 422.

The systems 300 and 400, as shown in FIGS. 3 and 4, respectively, both support several different advantageous modes of operation. Of course, the systems 300 and 400 may also operate in other modes that are not disclosed explicitly herein. For example, the systems 300 and 400 could be used for selecting certain conformers or charge states on the basis of ion mobility. Further, the systems 300 and 400 may operate in a way that combines at least some of the features of different modes of operation.

A first mode of operation is termed "multi-fill automatic gain control." In this first mode, each individual storage cell of the ion storage array 106 is filled a number of times that is sufficient to accumulate an ion population size that satisfies a predetermined readiness criterion. As such, ion groups comprising very low abundance ions may require two or more cycles of separation/filling to accumulate a sufficiently large ion population for a high-quality mass analysis. On the other hand, ion groups comprising very high abundance ions may require ion population size reduction after only one separation filling cycle. Reducing the ion population size in selected storage cells may be necessary in order to prevent those cells from becoming space-charge overfilled. Wide- or narrow-mass range pre-scans may be performed, using the downstream mass analyzer 108, to take a "snapshot" of the different ions that are present in an ion population and to determine the relative abundances thereof. For example, for panoramic mass analyzers such as an Orbitrap, time-of-flight, or linear trap, wide-mass range pre-scans are preferable, while for triple- and single-quadrupoles narrow-mass range pre-scans are more appropriate. Optionally, the ion beam bypasses the ion storage array 106 during the pre-scan, thus offering faster response. Alternatively, a single fill of one or more of the storage cells is performed during the pre-scan, thus taking into account peculiarities of ion separation and filling for particular cells. Based on the pre-scans, the moment of readiness of each of the cells may be predicted and used to subsequently control the release of the ions that are stored therein. In this way, each of the individual storage cells is subjected to a number of separation/fill cycles that results in the storage of ion populations within a predetermined desired range.

In a second mode of operation the storage of plural ion groups in different storage cells of an ion storage array is combined with additional narrowing of the m/z range of the ion groups prior to mass analysis. In the systems 300 and 400 the initial separation of the ion population into a plurality of different ion groups is based on a low resolution ion mobility separation, either distance-of-flight or time-of-travel. The ion groups that are formed during ion mobility separation may be subjected to a further separation, which is performed either after storage in the ion storage array 106 (as in system 300), or prior to storage in the ion storage array 106 (as in system 400). In particular, the initial ion mobility separation produces ion groups with mass/charge windows of roughly 40 Th. Of course, the mobility based separation is not totally aligned with mass-to-charge ratio, since the separation is influenced by other factors including ion conformation, structure effects and charge state. The further narrowing of the initial ion groups, using the ion trap array of system 300 or the quadrupole mass filter of system 400, is based on m/z and results in smaller ion groups with mass windows of about 4 Th, which allows for high quality mass analysis.

The individual storage cells of the ion storage array 106 are independently controllable, such that switching of one storage cell in the ion storage array 106 between an ion receiving mode and an ion storage mode, or between the ion storage mode and an ion release mode, is independent of the switching of any of the other storage cells in the ion storage array 106. As such, when a plurality of the individual storage cells are filled and ready to release the ions that are stored therein, a controller may be used to selectively switch the filled storage cells between the ion storage mode and the ion release mode in other than a fixed predetermined order. The switching order may be based on any desired criteria, such as for instance the order in which the storage cells became filled, the location of the individual storage cells within the ion storage array, etc.

While the above description constitutes a plurality of embodiments of the present invention, it will be appreciated that the present invention is susceptible to further modification and change without departing from the fair meaning of the accompanying claims.

What is claimed is:

1. An ion storage mass spectrometer, comprising:

an ion source for providing ions;

a first ion separator for separating the ions into a plurality of ion groups based on ion mobility or mass, each different ion group comprising ions within a different known mass or mobility window;

a second ion separator for further separating each of said plurality of ion groups into a plurality of ion sub-groups based on mass-to-charge ratio (m/z), each of the different ion sub-groups of each ion group comprising ions within a different known mass sub-window of the respective ion group mass or mobility window;

one or more mass analyzers for analyzing the ions of each ion sub-group; and an ion storage array comprising a plurality of independently operable ion storage cells, the ion storage array being one of:

i) disposed between the first ion separator and the second ion separator for receiving the plurality of ion groups from the first ion separator, for storing each received ion group within a different predetermined ion storage cell, and for selectively releasing said ion groups for introduction into the second ion separator; or ii) disposed between the second ion separator and the one or more mass analyzers for receiving the plurality of ion sub-groups from the second ion separator, for storing each received ion sub-group within a different predetermined ion storage cell, and for selectively releasing each of said ion sub-groups for introduction into the one or more mass analyzers.

2. The ion storage mass spectrometer of claim 1, wherein the first ion separator comprises a mobility-based ion separator having an ion introduction stage for receiving the ions from the ion source, and having a separation stage for separating the ions into the plurality of different ion groups based on differences in the mobilities of the ions.

3. The ion storage mass spectrometer of claim 2, wherein the second ion separator comprises an ion trap array comprising a plurality of ion trap devices, each ion trap device for separating one of the plurality of different ion groups into a corresponding plurality of the different ion sub-groups, and wherein the ion storage array is disposed between the first ion separator and the second ion separator.

4. The ion storage mass spectrometer of claim 3, comprising a secondary ion storage array disposed between each ion trap device and the one or more mass analyzers, each secondary ion storage array comprising a plurality of independently operable secondary storage cells, each of the secondary storage cell for storing ions corresponding to the known mass sub-window of only one ion sub-group.

5. The ion storage mass spectrometer of claim 4, wherein the ion trap array is disposed within a vacuum chamber, and comprising a first plurality of electrodes disposed adjacent to the ion storage array, the first plurality of electrodes cooperating to form a first ion transport section for receiving the ion groups that are released from the ion storage array when the storage cells are switched from the ion storage mode to the ion release mode, and for transporting the received ions groups along a path that extends through a vacuum interface and into the vacuum chamber.

6. The ion storage mass spectrometer of claim 5, comprising a second plurality of electrodes disposed between the vacuum interface and the ion trap array within the vacuum chamber, the second plurality of electrodes cooperating to form a second ion transport section for receiving the ion groups that are transported through the vacuum interface and for transporting said ion groups to predetermined ion traps of the ion trap array.

7. The ion storage mass spectrometer of claim 6, wherein the mobility-based ion separator effects a spatial separation of the ions along a length of the separation stage, and wherein the storage cells of the ion storage array are distributed along the length of the separation stage, and further comprising at least one guide electrode for establishing an electric field for directing the different ion groups into respective storage cells that are adjacent to the locations of the different ion groups along the length of the separation stage.

8. The ion storage mass spectrometer of claim 2, wherein the second ion separator comprises a quadrupole mass filter, and wherein the ion storage array is disposed between the second ion separator and the one or more mass analyzers.

9. The ion storage mass spectrometer of claim 8, comprising a first plurality of electrodes disposed between the quadrupole mass filter and the ion storage array, the first plurality of electrodes cooperating to form a branching guide for receiving each ion sub-group from the quadrupole mass filter and for directing the received ion sub-groups to predetermined storage cells of the ion storage array.

10. The ion storage mass spectrometer of claim 9, wherein the one or more mass analyzers is disposed within a vacuum chamber, and comprising a second plurality of electrodes disposed between the ion storage array and the one or more mass analyzers, the second plurality of electrodes cooperating to form a collecting guide for receiving the ion sub-groups that are released from the ion storage array when the storage cells are switched from the ion storage mode to the ion release mode, and for transporting the received ion sub-groups along a path that extends through a vacuum interface and into the vacuum chamber.

11. A method of mass spectrometric analysis, comprising:

providing a population of ions;

performing a first separation of the population of ions using a mobility-based ion separator, thereby forming a plurality of different ion groups, each different ion group comprising ions within a different known mass window;

performing a second separation of the population of ions, comprising separating each different ion group into a plurality of different ion sub-groups based on mass-to-charge (m/z) ratio, each different ion sub-group comprising ions within a different known mass sub-window of the respective ion group mass window;

providing an ion storage array comprising a plurality of independently operable ion storage cells, each storage cell supporting the trapping of only one ion group or only one ion sub-group; and one of:

trapping within each storage cell only one ion group of the plurality of different ion groups, subsequently releasing the ions that are stored within at least one storage cell of the plurality of storage cells, and subjecting the released ions to the second separation; and trapping within each storage cell only one ion sub-group of the plurality of different ion sub-groups, subsequently releasing the ions that are stored within at least one storage cell of the plurality of storage cells, and subjecting the released ions to mass analysis using a mass analyzer.

* * * * *